United States Patent [19]

Poulsen

[11] 4,077,303

[45] Mar. 7, 1978

[54] APPARATUS FOR GENERATING AN IMPACT FORCE

[76] Inventor: Peder Ulrik Poulsen, Loenholt Ladegaard, DK-3480 Fredensborg, Denmark

[21] Appl. No.: 676,867

[22] Filed: Apr. 14, 1976

[51] Int. Cl.[2] ..... F01L 15/00; F01B 7/18

[52] U.S. Cl. ..... 91/50; 91/235; 92/30; 92/130 C; 92/130 D

[58] Field of Search ..... 92/130 C, 130 D, 166, 92/130 A, 30; 91/337, 50, 235, 321

[56] References Cited

U.S. PATENT DOCUMENTS

| | | | |
|---|---|---|---|
| 1,749,924 | 3/1930 | Runge et al. | 92/30 |
| 1,801,259 | 4/1931 | Barks | 91/337 |
| 2,251,323 | 8/1941 | Burke | 92/30 |
| 2,261,925 | 11/1941 | Salzer | 92/30 |
| 2,389,405 | 11/1945 | Birchfield | 92/130 C |
| 2,678,538 | 5/1954 | Cowan | 92/130 C |
| 2,933,069 | 4/1960 | Grotzmuller | 92/130 C |
| 3,007,454 | 11/1961 | Joelson | 91/321 |

FOREIGN PATENT DOCUMENTS

| | | | |
|---|---|---|---|
| 201,793 | 7/1958 | Austria | 92/130 C |

*Primary Examiner*—Paul E. Maslousky
*Attorney, Agent, or Firm*—Burgess, Ryan and Wayne

[57] ABSTRACT

A mechanism for generating a high impact force for hammering, pounding, stamping, forging or similar operations. A piston is slidably mounted in a fluid pressure chamber, and has a larger cross sectional area at one end of the chamber than at the other end thereof. A fluid is introduced into the chamber under pressure, and exerts a net axial force on the large cross section end of the piston. One end of the piston outside the chamber forms a cam, which is engaged by a spring loaded cam follower to prevent axial movement of the piston until the force thereon exceeds a predetermined value. When the force on the piston exceeds said value, the cam is suddenly disengaged from its follower, permitting rapid movement of the piston under the fluid pressure. When the piston reaches the end of its travel, fluid is permitted to leave the chamber so that the pressure on the piston rapidly decreases, and the spring loaded cam follower acts on the cam to return the piston to its initial position.

2 Claims, 5 Drawing Figures

APPARATUS FOR GENERATING AN IMPACT FORCE

Figure 1:
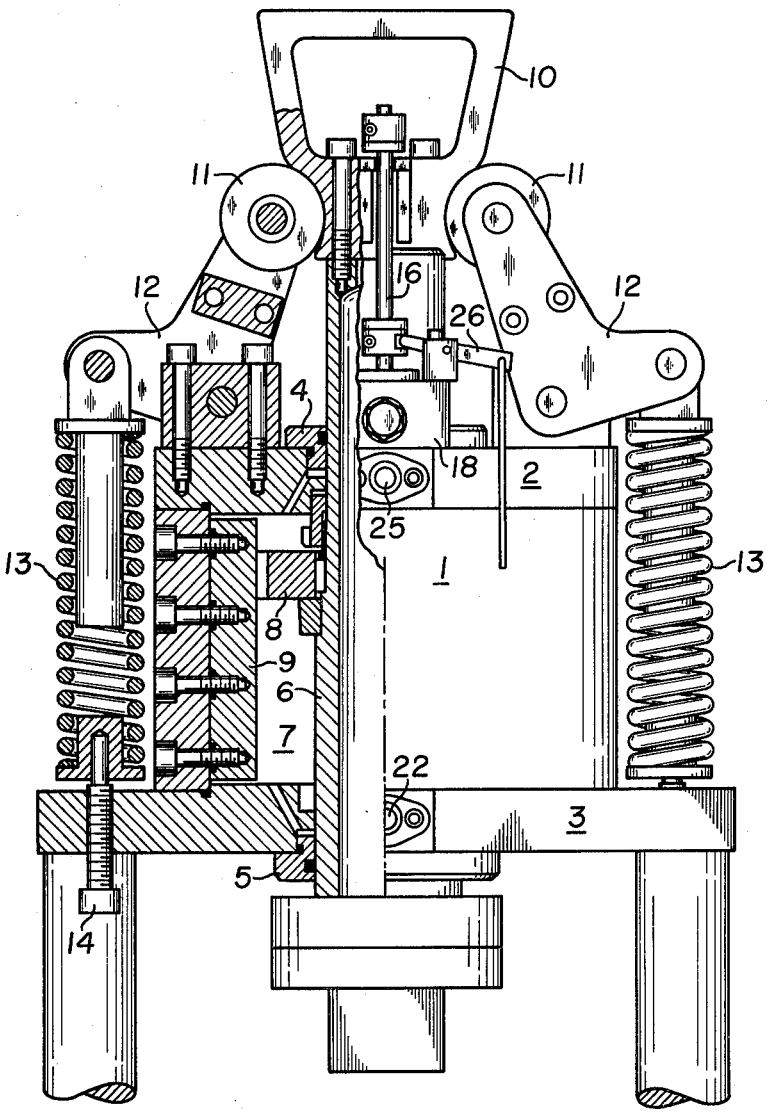

The invention relates to a method of releasing kinetic energy, more precisely, releasing kinetic energy in one direction, e.g. for processing of materials in a technological process. The invention is more particularly, but not exclusively, concerned with presses for high energy rate forming operations such as forging, impact extrusion, cropping, blanking and pinching.

The accumulation and release of kinetic energy is in practice limited to the utilization of few physical phenomena. It is thus known to accumulate energy in a flywheel and to make a sudden braking of the flywheel to transform the energy into heat, electric current or power. In the latter case for instance may be obtained a hammer blow, by means of which a large amount of energy may be transformed within a short time. This, however, demands strong machine structures, because the efficiency is comparatively small and comparatively strong powers are to be transformed. It is also known to compress gases and to make transformation of a movement in one direction via a piston. On account of the special physical structure of the gases, including large compressibility, critical drops in pressure etc. it is, however, not practically possible (without large machines) to transform large amounts of energy in a short time in this way. Finally it is known to provide a sudden movement in one direction by the use of explosives.

The object of the present invention is to provide a new method of the said kind, relying solely on mechanical movements, and by which high efficiency may be achieved in the transformation of energy.

According to one aspect the invention provides a method of releasing kinetic energy in a single direction, in which a liquid is compressed in a closed chamber and in which the pressure in the chamber is released suddenly when the pressure therein reaches a predetermined level, such that the flowing determined by the sudden drop in pressure is brought to act as a power in the said one direction. With such an arrangement it is possible to accumulate and release quite large amounts of energy in comparatively small chambers with a good efficiency, and the method may, therefore, find use for a large number of practical purposes.

Oil may be used as liquid, e.g. silicone-oil, which is compressed by 4% volume by a rise in pressure of about 300 atmospheres.

The effect can be further increased by using according to the invention chambers with elastic walls, e.g. of metal. The chambers used for this purpose must naturally be constructed with a considerable rigidity, and naturally it can hardly be avoided, that the said effect occurs. It is, however, possible to increase the effect by suitable dimensioning.

If the method is carried out in connection with a fluid, which is a combination of a liquid and a gas, it can be characterized in, that the liquid and the gas is separated by an elastic wall, and that the compression action, i.e. the pumping action, and the releasing action are exerted on the liquid and from the liquid, i.e. the liquid is the working medium. As the compression of gasses is very different from the compression of liquids it is possible to vary the characteristics of the energy releasing process to a very great degree when dimensioning the space of the gas compression chamber in relation to the compression chamber for liquid.

The invention also provides, in accordance with a second aspect, apparatus for carrying out the method according to that described above, characterized by a closed chamber, through which a piston extends, which piston passes through the end walls of the chamber and extends outside the chamber at both ends thereof, the cross-sectional area of the piston at one end of the chamber being larger than at the other end thereof, and in that there are means for releasably gripping of the movement of the piston in the direction towards the end at which the piston has its largest cross-sectional area, and means for pumping or pressing liquid into the chamber round the piston. Such apparatus may be worked with relatively small differences in the cross-sectional area between the two ends of the piston, and it is therefore possible to get a practical usable construction, whereby the piston is influenced by a very strong power over a distance, which is big enough to build up a considerable piston speed simultaneously with the piston having a certain mass. Such an apparatus may, therefore, be used advantageously for technological shaping processes, demanding large transformations of energy in a short period of time. The apparatus may, therefore, be used as an alternative for eccentric presses.

According to the invention the apparatus may for this purpose be provided with means for return of the piston in the direction towards the end, the cross section of which is the smallest, and means for release of the pressure in the chamber, when the piston after release of the gripping means has moved in the direction towards the end with the largest cross section. These means may according to the invention be one or more springs, e.g. elastic or pneumatic.

According to the invention the apparatus can furthermore having means for halting the flow of liquid from the chamber, when the return is ended. This facilitates operation of the apparatus.

The apparatus can besides be characterized in that the longitudinal axis of the piston is mainly vertical, that the lower end, is the end with the largest cross section, in that this end is designed as or with a processing element, e.g. a chisel or a shaping element, and that the means for releasable gripping of the piston against its movement in downwards direction are located on the upper side of the chamber and are arranged for co-operating with the end of the piston, projecting upwards from the chamber. Such a construction can as to strength be very advantageous as the pressure chamber has beforehand been made very rigid. By locating the gripping means anchored in the beforehand rigid construction all efforts can be concentrated on this chamber.

An advantageous embodiment of this structure is characterized in that the cross section of the piston is circular and that the means for releasable gripping of the piston against its movement in a downwards direction are carried out by:

1) a plate-shaped curved body mounted on the upper end of the piston, said body being located in a vertical plane, and the lateral edges of which get near to each other in the downwards direction, as they are symmetrical about a vertical axis, which converges with the axis of the piston.
2) a couple of swivel arms which are embedded symmetrically about a vertical axial plane through the piston and having axes perpendicular to the plane of the curved body at the upper side of the housing with horizontal axis, and which at their upper ends carry rollers which are arranged for engaging each its own lateral edge of the curved body, and which are spring loaded towards the latter by springs, which are located in such a manner, that their reactive forces essentially are received by the chamber or a support directly connected therewith, and in that the lateral edges of the curved body at foot are circular with a radius corresponding to that of the rollers, and that the tangent planes in the upper points of contact between rollers and the curved body are sloping towards each other, i.e. towards the plane of symmetry.

Hereby it is possible by suitable choice of curved body, location of the swivel arms, rod system for transmission of the power to the springs etc. to fix the point of time of release and the reverse power in dependence on the distance.

Finally an apparatus for use in high energy rate forming operations can be characterized in that the movement of the tool is carried out by hydraulically acting pressure in the closed chamber, through which the piston extends, that this chamber is connected to a hydraulic accumulator containing a compressible closed bag in which there is a compressed gas, and that the energy for the stroke is determined from deformation of the chamber's walls, compression of the liquid and compression of the gas. In using gas as part of the compressed medium it is possible to use a liquid, which is very incompressible. It is for instance possible to use ordinary oils instead of silicone oil, which is relatively compressible but rather expensive. When partly using gas compression, it is possible to choose a reasonable energy release curve according to a certain technical task. It is even possible according to the invention to have a number of hydraulic accumulators coupled to the closed chamber via pipes. These pipes may selectively be closed or opened by means of valves, so that a suitable energy releasing characteristic or curve may be achieved according to different tasks of the apparatus.

Figure 3:
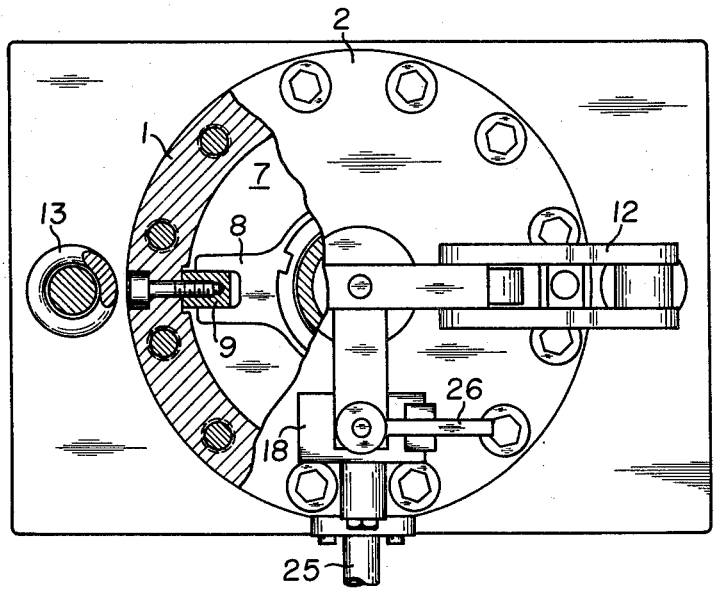
Figure 2:
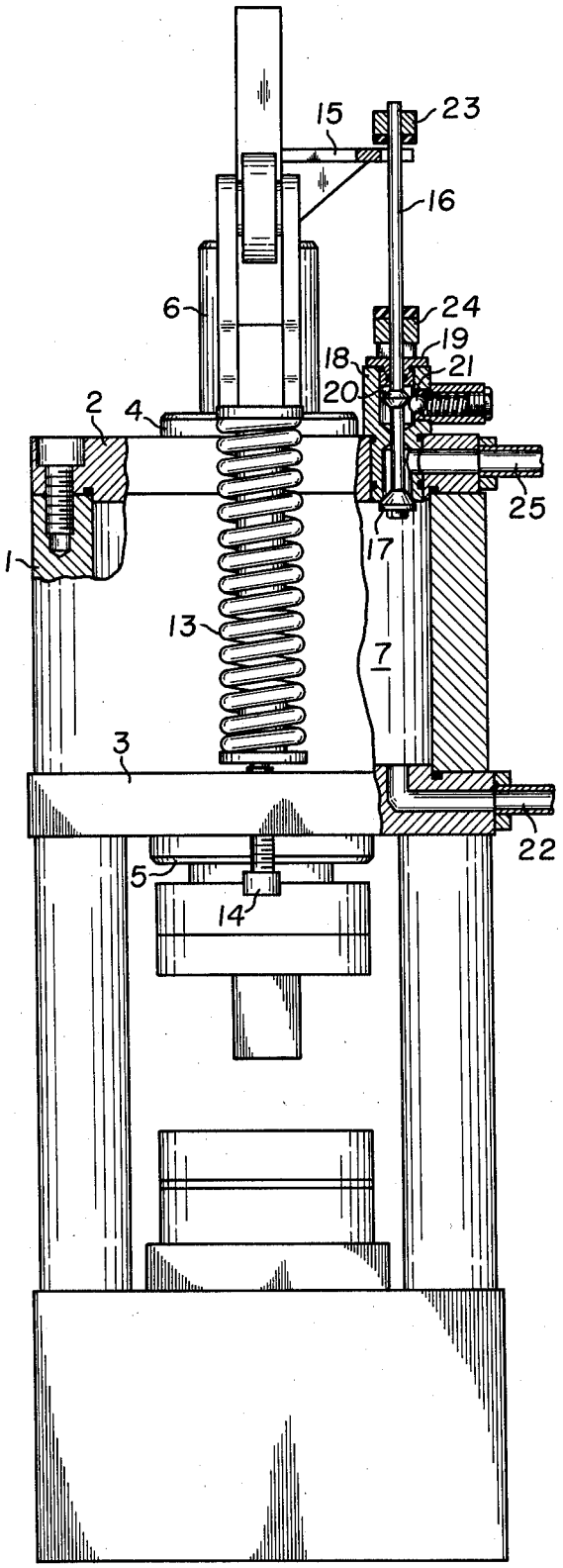
Figure 5:
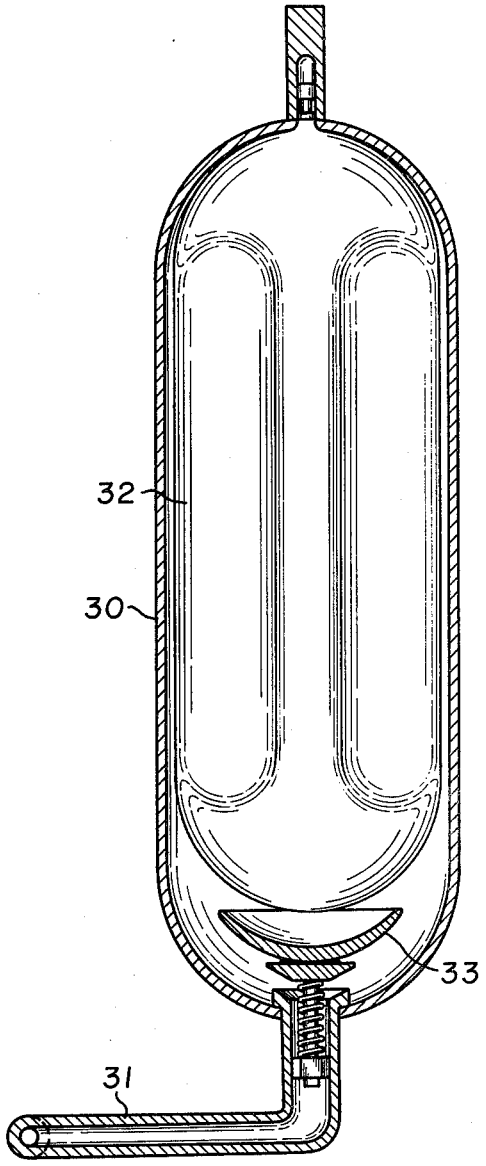
Figure 4:
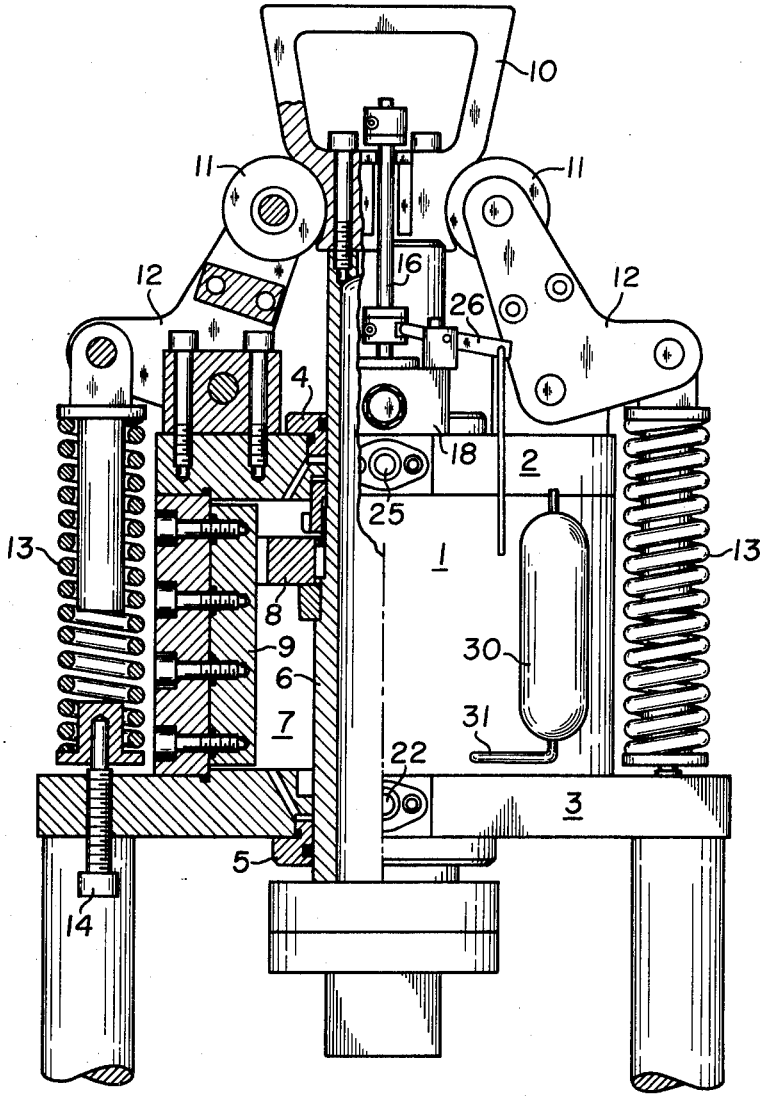

The invention will be described in detail in the following with reference to the drawing wherein, FIG. 1 is a part sectional view of a machine according to the invention, FIG. 2 is a part sectional view of the machine of FIG. 1 seen from one side, FIG. 3 is a view of the machine seen from above, FIG. 4 is a part sectional view of a machine according to another embodiment of the invention mounted with a hydraulic accumulator, and FIG. 5 shows an axial cross section in an enlarged scale of the hydraulic accumulator.

With reference to the drawings a heavy walled pipe 1 is closed at both ends by the plates 2 and 3 and provided with O-ring seals to seal off an annular chamber 7.

Guide bushings 4 and 5 are fitted into central bores in plates 2 and 3 respectively and provided with internal and external O-ring seals. The bushings 4 and 5 serve to guide a tubular stepped piston 6 and when chamber 7 is pressurized the piston is subjected to a force acting vertically downwards and equal to the product of the pressure and the difference between the cross sectional areas of the piston at 5 and 4. During its travel the piston is guided axially by the bushings 4 and 5 and it is secured against rotation by a fork 8 which is keyed onto the piston and guided at the free end by a vertical rail 9. This is fastened onto the internal surface of pipe 1 by means of bolts passing through the wall of the pipe 1 and which are sealed off individually to prevent oil leakage.

A cam 10 is bolted onto the top of the piston and two cam rollers 11, mounted in rocker arms 12, are pressed firmly against the tapered sides of the cam 10 by means of two heavy coil springs 13.

On one face of the cam is fitted a bracket 15, the forked end of which encompasses a cylindrical rod 16. The lower end of rod 16 is provided with a valve cone 17 and when adjustable dogs 23 and 24 are hit by the fork the rod is shifted axially in the valve block 18 whose upper end is closed by a cover 19 provided with internal and external O-ring seals. The mid part of rod 16 is shaped like a double cone 20 which is engaged by a spring loaded ball 21 serving to hold the valve cone 17 either pressed firmly against its seat or in the fully open position. The punch and die parts of a tool for a blanking operation or another forming job are fitted firmly onto the lower end of the piston and the press platen respectively.

The press is powered from a hydraulic pump unit not shown containing a compressible fluid such as silicone oil which may typically be compressed about 4% of its volume when subjected to a pressure in the range of 300 atmospheres. When the machine is working the working fluid is pumped continuously and at a steady rate via pipe 22 into the annular space 7.

In the situation illustrated on the drawing the valve 17 has just been closed as the piston reached its uppermost position, when the dog 23 was hit by bracket 15. The dogs 23 and 24 are provided with resilient washers to protect the valve from shock loads. As the oil is flowing through pipe 22 into the chamber 7 with no chance of escape the pressure will build up rapidly and so will the force on the piston until it exceeds the counteracting vertical component of the force acting inwards on cam rollers 11.

When this situation is reached the rollers 11 give way rapidly allowing the piston and cam to move downwardly.

During its movement the piston is still subject to the vertical counterforce which is a function of the spring pressure and the geometry of the cam 10. Typically the piston may be released when the force downwards reaches 3000 kp and the force acting upwards on the piston may be in the range of 500 kp when it reaches its lower position.

As the piston completes the stroke the fork 15 hits the dog 24 and the valve opens whereafter the pressure in the chamber 7 drops rapidly. Now the piston is returned by spring pressure, acting through the cam arrangement, and as it reaches its uppermost position the valve 17 is again closed whereafter the process will repeat itself in a continuous stroke fashion.

During the entire cycle the fluid flows continuously into the chamber but during the piston's return stroke fluid leaves the chamber 7, with no pressure buildup, via pipe 25. The energy for the stroke is supplied during the compression phase and down-stroke and the pump will idle during the return stroke. However, a more even loading of the motor may be effected by the use of a suitable flywheel coupled to the motor shaft.

The machine can be set to make individual strokes by removing dog 23, the compression phase being started manually by moving the rocker arm 26 to close valve 17. As in a crank press this may be triggered by a two hand lock for added safety.

After the valve has been closed there will be a short delay as the pressure builds up in chamber 7 but because of the high cycling rate this delay will be of little significance.

It will be seen that the amount of energy delivered in the stroke and the power/travel pattern of the return stroke may be adjusted by varying the shape of the cam.

For example the return force may be raised generally by adding to the degree of taper of the entire cam, and locally near the lower position by using a higher degree of taper near the top of the cam. The release force may be adjusted by varying the depth of the concave parts of the cam and by this means any value can be reached within the range of the machine.

In practice the press may be supplied with a number of sparo cams shaped differently for a variety of jobs and in addition the release and return force may be adjusted by means of screws 14. It is of course within the scope of the invention to replace the coil springs by pnuematic cylinders so that the variables mentioned can be governed from a control panel.

When the press is used for blanking operations it is a further advantage that the hydraulic system may also be used to feed the material strips through the machine. This can be arranged easily be means of a spring-return adjustable stroke cylinder with a friction device or a clamp to move the strip stepwise during the intervals between the press strokes. Now the cylinder is coupled in parallel with the pressure chamber 7 which means that the strip will advance during the pressure buildup while the piston rests in its top position.

FIG. 4 shows a machine as in FIG. 1 but a hydraulic accumulator 30 is mounted on this machine. The hydraulic accumulator is put into connection with the chamber 7 via a pipe 31. In this pipe there may be arranged a valve to make it possible to put the hydraulic accumulator out of service. The accumulator 30 is shown in an enlarged scale and in axial cross section in FIG. 5. Inside the accumulator is mounted an elastic bag 32. This bag may be preloaded with a gaseous pressure up to for example 100 atmospheres. However, in the shown condition a counterpressure of a liquid has been applied through the pipe 31 thereby collapsing the bag a little in direction upwards. To ensure that the bag 32 stays inside the accumulator 30 a sort of counterpressure valve 33 is mounted in the lower end of the accumulator, i.e. when no counterpressure of liquid is applied then the bag 32 will expand and close the counter valve 33. In this way the "elasticity" of the energy absorbing system may be increased. It is possible to obtain an arbitrary degree of elasticity in choosing the proportions or relative sizes of piston chamber and the accumulator as well as the preloading of it. The using of a hydraulic accumulator makes it also possible to use a very incompressible liquid as for instance an ordinary oil. Silicone oil was at first found to be a suitable oil as it is 3 to 4 times more compressible than most liquids. However, silicone oil is rather expensive and the use of an accumulator makes it possible to use an ordinary oil. Furthermore the use of a number of different sized accumulators connected in a selective way to the piston chamber makes it possible to make a choice between a number of characteristic energy releasing curves for the same machine. The cam 10 may be easily changed as well according to different tasks, thereby increasing the versatility of the machine.

What I claim is:

1. Apparatus for generating an impact force, comprising:

a pressure chamber;

a piston slidably movable within the chamber, said piston extending through the opposite end walls of said chamber, the cross-sectional area of the piston at one end of the chamber being greater than the cross-sectional area thereof at the other end of said chamber, said piston having a generally vertical longitudinal axis, a lower end adjacent said one end of said chamber, and an upper end adjacent said other end of said chamber, said ends of said piston being outside said chamber;

means for connecting a tool to said lower end of said piston;

an inlet conduit for introducing a fluid into said chamber under pressure, said fluid acting on said piston to exert an axial force thereon in a given direction;

means connected in operative engagement with the upper end of said piston for releasably gripping said piston to prevent axial movement thereof when said axial force is below a predetermined value, and to suddenly release said piston to permit axial movement thereof in said given direction when said axial force exceeds said predetermined value, said releasable gripping means comprising a cam affixed to the upper end of said piston, and a cam follower roller engaging said cam, spring means for biasing said roller into contact with said cam, so that said roller exerts an upward force on said cam, and means for reducing the pressure of said fluid in said chamber by removing fluid therefrom, and for moving said piston in a direction opposite to said given direction, when the piston has moved in the given direction towards the end with the larger cross-section following release of the gripping means.

2. Apparatus for generating an impact force, comprising:

a pressure chamber;

a piston slidably movable within the chamber, said piston extending through the opposite end walls of said chamber, said piston having a circular cross-section, the cross-sectional area of the piston at one end of the chamber being greater than the cross-sectional area thereof at the other end of said chamber, said piston having a generally vertical longitudinal axis, a lower end adjacent said one end of said chamber, and an upper end adjacent said other end of said chamber, said ends of said piston being outside said chamber;

means for connecting a tool to said lower end of said piston;

an inlet conduit for introducing a fluid into said chamber under pressure, said fluid acting on said piston to exert an axial force thereon in a given direction;

means connected in operative engagement with the upper end of said piston for releasably gripping said piston to prevent axial movement thereof when said axial force is below a predetermined value, and to suddenly release said piston to permit axial movement thereof in said given direction when said axial force exceeds said predetermined value, said releasable gripping means comprising a plate shaped camming body mounted on the upper end of the piston, said body being disposed in a vertical plane and having vertically oriented lateral edges which taper toward each other in the downward direction, said lateral edges being symmetrically disposed about a vertical axis coincident with the axis of the piston, a pair of swivel arms symmetrically disposed on opposite sides of said piston vertical axis, each of said arms being rotatable about a horizontal axis adjacent a corresponding lateral edge of said camming body, a roller rotatably mounted on each of said swivel arms adjacent and in engagement with the corresponding lateral edge of said camming body, spring means for imparting rotational torque to each of said swivel arms to maintain said rollers in engagement with said lateral edges of said camming body, to apply an upward force to said camming body and the piston to which said camming body is affixed, said swivel arms and spring means being mechanically connected to said chamber, each of said lateral edges having a recess therein for receiving a portion of the periphery of the corresponding roller, the radius of curvature of each recess being equal to that of the corresponding roller; and means for reducing the pressure of said fluid in said chamber by removing fluid therefrom, and for returning said piston to the initial position thereof by moving said piston in a direction opposite to said given direction, when the piston has moved in the given direction towards the end with the larger cross-section following release of the gripping means.

* * * * *

UNITED STATES PATENT OFFICE

CERTIFICATE OF CORRECTION

Patent No. 4,077,303 Dated March 7, 1978

Inventor(s) Peder Ulrik Poulsen

It is certified that error appears in the above-identified patent and that said Letters Patent are hereby corrected as shown below:

Column 5, line 14: "sparo" should be --spare--.

line 18: "pnuematic" should be --pneumatic--.

line 23: "be" (2nd occurrence) should be --by--.

Column 8, lines 8-9: "for returning said piston to the initial position thereof by" should be cancelled.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*